United States Patent [19]

Damm et al.

[11] Patent Number: 4,741,483

[45] Date of Patent: May 3, 1988

[54] APPARATUS FOR MIXING SOLIDS AND LIQUIDS

[75] Inventors: Norbert Damm, Karlsdorf-Neuthard; Thomas Parr, Karlsruhe, both of Fed. Rep. of Germany

[73] Assignee: BMD Badische Maschinenfabrik Durlach GmbH, Fed. Rep. of Germany

[21] Appl. No.: 883,758

[22] Filed: Jul. 9, 1986

[30] Foreign Application Priority Data

Jul. 10, 1985 [DE] Fed. Rep. of Germany ..... 3524537

[51] Int. Cl.[4] ..... B02C 23/36

[52] U.S. Cl. ..... 241/46.17; 241/199.12; 366/296; 366/300

[58] Field of Search ..... 366/64, 65, 66, 67, 366/293, 294, 295, 296, 325, 327, 329, 279, 300, 299; 241/101 B, 166, 291, 199.12, DIG. 10, 46 R, 46.06, 46 B, 46.08, 46, 11, 46.17

[56] References Cited

U.S. PATENT DOCUMENTS

| | | | |
|---|---|---|---|
| 1,027,531 | 5/1912 | Fay | 366/296 |
| 3,322,404 | 5/1967 | McIlvaine | 366/296 |
| 4,154,540 | 5/1979 | Hammann | 366/296 |
| 4,509,860 | 4/1985 | Lasar | 366/296 X |

*Primary Examiner*—Mark Rosenbaum

*Attorney, Agent, or Firm*—Antonelli, Terry & Wands

[57] ABSTRACT

An apparatus for mixing solids with one another and with liquids, particularly for producing moulding sand mixtures, comprises a circular, fixed trough and at least two groups of mixing tools engaging with different spacings from the trough axis and trough bottom, which revolve about the trough axis and set with opposite angles with respect to the tangent of the circular path thereof. In order to obtain both a horizontal and vertical movement of the material being mixed in the case of maximum throughput, the mixing tools are formed in paddle-like manner from part cylindrical circumferential segments with roughly horizontal axis of curvature, the mixing paddles of the outer group point inwards with their concave side, while those of the inner group point outwards. There are also separate, revolving wall strippers for the inner and outer trough walls.

17 Claims, 6 Drawing Sheets

APPARATUS FOR MIXING SOLIDS AND LIQUIDS

BACKGROUND OF THE INVENTION

The present invention relates to an apparatus for mixing solids with one another and with liquids, particularly for producing foundry moulding sand mixtures, comprising a circular, fixed trough with a vertical axis and at least two groups of mixing tools fixed to arms, which revolve with a relative speed and preferably in opposite directions with a different spacing from the trough axis and from the trough bottom and are so inclined with respect to the tangent of their circular path or orbit under opposite angles, that the mixing tools of the outer group feed the material being mixed inwards and the mixing tools of the inner group feed the material being mixed outwards.

In an apparatus of the aforementioned type (U.S. Pat. No. 4,154,540), the drive of the mixing tool groups is located in the vicinity of the trough axis, each group of tools having its own drive. The mixing paddles or blades are connected by means of supporting arms to the driving shaft. Gear connections are optionally provided between the supporting arms. This known mixer, which is particularly intended for mixing building materials, e.g. concrete mixtures, has an inner and an outer group of mixing tools with the same rotation direction revolving over the trough bottom and another group of mixing tools revolving in the opposite direction in the overlap region thereof and above the same. The mixing tools are simple plates, positioned perpendicularly to the trough bottom, which are set at an angle with respect to the tangent of their circular path or orbit. Due to a differing setting of the mixing tools, the material being mixed is conveyed from both the outer and inner regions of the trough in the direction of the overlapping region of the two first mixing tool groups and there is carried in the opposite direction by the mixing tool group located above it.

Compared with mixers with mixing tools revolving in only one direction or with stationary tools and a revolving trough, the aforementioned mixer has the major advantage that the material being mixed is not only alternately moved from the outside to the inside and vice-versa, but is also exposed to a constant shear load. Thus, homogeneous mixing in the case of a high flow rate is achieved for a large number of starting components.

However, this leads to considerable problems in the case of foundry moulding sands in that in addition to the quartz sand used as the main part, there are various solid and usually pulverulent aggregates and liquid cementing or binding agents with different viscosities which have to be processed. The individual solid and liquid components have widely differing specific gravities, so that within the mixer layers having different component enrichment or concentration levels are formed within the mixer due to sedimentation movements and it is very difficult to break them up. Unlike in the case of concrete mixtures, in the case of moulding sand mixtures, each individual particle must be surrounded by a cementing agent layer, which on the one hand requires a corresponding contact time between the cementing agent and the moulding sand particles and on the other hand requires corresponding forces, e.g. frictional forces, which lead to the pressing of the cementing agent onto the particles. These functions can not or can only be inadequately fulfilled by a mixer of the aforementioned construction. It has also been found that with increasing viscosity, the material being mixed does not sufficiently rapidly drop from the mixing tools again and is instead carried along over a longer distance, so that the more viscous the mixture, the longer the mixing time. Finaly, the filling level and therefore the throughput per mixing cycle is limited by the mixing tools only revolving in two planes.

Thus, in the past, mixer having a special construction have been developed, which takes account of the special circumstances connected with foundry moulding sand. Thus, it is known (DE-C-1 204 632) to arrange different mixing and kneading or rolling tools within a revolving trough, which are driven about axes running parallel to the trough axis, partly in opposite and partly in same directions. As a result of this construction, the mixing components are subject to different movements and forces, which is intended to lead to a good mixing quality. In another known mixer (U.S. Pat. No. 3,964,733), radially arranged mixing arms having paddles revolve over the bottom of the stationary trough and convey the material being mixed in the circumferential direction and also raise the same by setting counter to the rotation direction. Above said mixing arms, centrifugal tools rapidly rotating eccentrically to the axis engage in the trough, constantly tear apart the upper layer of the material being mixed and centrifuge the latter in opposite directions. This mixer also leads to a satisfactory mixing quality, but requires considerable driving forces and leads to a high degree of wear.

It is finally known (DE-A-1 557 252) to use a plurality of planar mixing tools revolving about vertical axes in a revolving trough and to move the material being mixed from the outside to the inside by stationary deflector plates. In addition, mixing tools are provided having on a vertical axis a plurality of spaced, superimposed, planar paddles, which impart a vertical movement to the material being mixed. Thus, in this mixer horizontal and vertical movements are superimposed in the material being mixed. It is disadvantageous in this construction and in many of those described hereinbefore, that the differently acting mixing tools always require their own drive, so that accessibility from above to the trough is considerably impaired. Due to the asymmetrical arrangement of the mixing tools dead spaces or gaps are formed, in which the material being mixed is only exposed to a particular component of force or motion, so that the different effects on the material being mixed occur at different geometrical locations and there is no true superimposing of said effects. Thus, the residence time is correspondingly long and the mixer volume inadequately used.

The invention is initially based on the known fact that an optimum mixing quality, particularly in the case of foundry moulding sands, requires both horizontal and vertical components of motion within the material being mixed. In addition, the mixture is to be exposed to constant shear loads, in order to effectively counteract the formation of agglomerates.

SUMMARY OF THE INVENTION

On the basis thereof, the problem of the present invention is to impart the aforementioned force and motion components to the material being mixed by means of simply constructed mixing paddles and to increase output compared with conventional mixers.

On the basis of the apparatus of the aforementioned construction (U.S. Pat. No. 4,154,540) according to the invention this problem is solved in that the mixing tools are constructed in paddle-like manner as circumferential segments of a circular cylinder with an approximately horizontally arranged axis and the mixing paddles of the outer group are directed inwards with their concave side, while those of the inner group are directed outwards with their concave side and a twisting movement is imparted to the material being mixed, revolving wall strippers being associated with the insides of the outer and inner trough walls.

The paddle-like mixing tools according to the invention, as a result of the leading cutting edge, skim from the material being mixed a partial flow and direct it, as a function of the angular setting, inwards or outwards. Simultaneously, a twisting movement is imparted to this partial flow and within it the mixing components are moved both horizontally and vertically. As a result of this "skimming process", compressive and shear forces occur, which press the cementing or binding agent onto the moulding sand particles. Thus, within the material being mixed strings are formed which, after leaving the trailing edge of the mixing paddle, partly disintegrate again or are broken down again by the mixing paddle groups. Due to the fact that the mixing paddles of the two or more groups are, as known, set at opposite angles with respect to the tangent of their circular path or orbit, the necessary radial movement is imparted to the material being mixed from the inner region of the trough to the outside or from the outer region to the inside. As a result of the twisting movement, even in the case of viscous mixtures it is ensured that the material being mixed is only carried and not circulated circumferentially over long distances. As a result of the arrangement of mixing paddles, particularly of the inner group, in different height positions above the trough bottom, a considerable filling level is possible, while simultaneously ensuring a constant transfer from top to bottom and vice versa. Due to the fact that the mixing paddles comprise circumferential segments of a circular cylinder, they can easily be manufactured. This is assisted by the further measure, that beside the mixing paddles separate wall strippers are provided, in that they are given a simple linear construction. As these components are subject to a considerable amount of wear, this fact facilitates the setting or replacement thereof, while the mixing paddles which have a comparatively complicated shape are only exposed to the mixing forces.

Admittedly mixers with curved mixing paddles with a horizontal axis of curvature are known (DE-C-801 618), but these are located only in one plane, so that the filling level is very low. Moreover, conveying or transfer mainly takes place in a horizontal plane. The mixing paddles are not curved in a part cylindrical manner, so that their manufacture is relatively complicated. Finally, the innermost and outermost mixing paddles act as wall strippers and are consequently subject to considerable wear, particularly as, as in the case of all other mixing paddles, they act as bottom strippers.

According to a preferred embodiment, the mixing paddles have a leading cutting edge sloping counter to the rotation direction and a roughly horizontal, trailing lower cutting edge. It is also advantageous for the leading cutting edge to pass into the lower cutting edge via an arcuately curved edge. Thus, the circumferential segment forming the mixing paddle is cut back to the absolutely necessary surface area, in order to obtain the desired movements and consequently there is no need to overcome unnecessary compressive and frictional forces, which bring about no mixing action. This also prevents sticking or caking on the leading cutting edge and the partial flow, which is to be given a twisting movement is started at different levels.

According to a preferred embodiment of the invention, the mixing paddles are inclined upwards counter to their rotation direction with respect to the horizontal plane. As a result of this measure, an even more marked vertical component of motion can be imparted to the material being mixed.

According to a further advantageous embodiment, the mixing paddles of the outer group comprise two or more superimposed circumferential segments of a circular cylinder, which are connected along a generatrix. Thus, the material being mixed can be externally engaged by a single tool over the entire filling level and subdivided into two or more partial flows, which are in each case given a twisting movement. In this embodiment, the connecting line of the two circumferential segments has a larger radial spacing from the trough axis than the outer edge bounding the circumferential segments.

The effectiveness of the mixer can be further increased in that e.g. the mixing paddles of the inner group have different spacings from the trough axis and/or trough bottom. In addition, the vertical component of motion can also be influenced or increased in that e.g. the mixing paddles of inner group are driven about an axis inclined with respect to the trough axis. It is also possible to drive the mixing paddles of the inner group about an axis arranged eccentrically to the trough axis.

According to another feature of the invention, further part cylindrical mixing paddles with vertical axis of curvature are associated with the outer group of mixing paddles and the leading edge thereof has a greater radial spacing from the trough axis than the trailing edge. The mixing paddles with vertical axis of curvature mainly guide the material being mixed inwards, whilst those with a horizontal axis of curvature give the material being mixed an inwardly directed twisting movement.

Preferably, in each case one part cylindrical mixing paddle with a vertical axis of curvature is connected to a mixing paddle with a horizontal axis, the latter being positioned at the top, whilst the former extends roughly to the bottom of the trough. This in particular ensures that specifically lighter components, which mainly collect on the surface are constantly circulated and intermixed, whereas in the lower region with the vertical mixing paddles there is no significant vertical transport, so that the light components are not conveyed to the surface again. This effect occurs to an increased extent, if the mixing paddle with the horizontal axis of curvature projects over the surface of the material being mixed. As a result of the vertically positioned mixing paddles, the emptying of each charge is also facilitated.

According to a further embodiment, the wall strippers for the inner trough wall rotates synchronously with the mixing paddles of the inner group and those for the outer trough wall with the mixing paddles of the outer group. Thus, the mixing paddles and wall strippers can be supplied by the same drive.

Preferably, in each case one wall stripper for the outer trough wall is positioned in the rotation direction behind each mixing paddle of the outer group. Due to the fact that the wall stripper follows the mixing paddle, the stripped material drops into the free space produced by the leading mixing paddle, which displaces the material inwards. This stripped material is then taken up by the following mixing paddle and conveyed inwards, which ensures that no material remains for a long period in the vicinity of the wall.

Finally, the wall strippers can have interchangeable and/or adjustable anti-wear strips.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
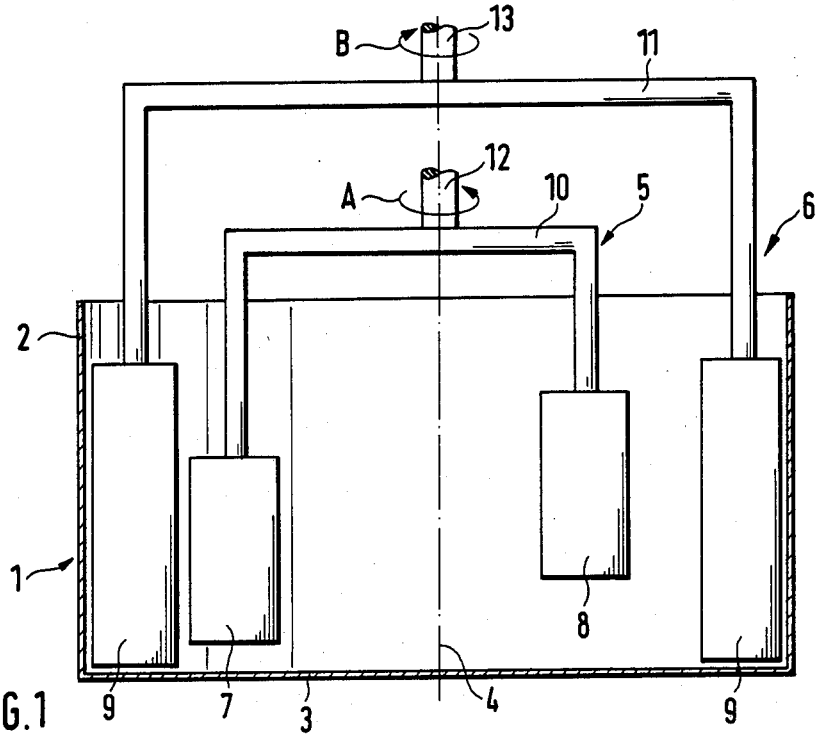
FIG. 1, a diagrammatic view of an embodiment of the apparatus.

The mixer shown in FIGS. 1 to 9 comprises a fixed trough 1 with a cylindrical casing 2 and horizontal bottom 3. The trough axis is 4. From the top several and in the represented embodiment two groups 5, 6 of mixing paddles engage in the trough, group 5 having paddles 7, 8 and group 6 paddles 9. For ease of representation, in FIGS. 1 to 3 the mixing paddles are merely shown as rectangular structures, while their actual shape is described relative to FIG. 4 .

The groups 5, 6 of mixing paddles 7, 8 or 9 revolve with different radial spacings from the trough axis 4 and for this purpose are located on supporting arms 10 or 11, which are in turn connected via driving shafts 12, 13 to a drive, while optionally interposing gears. As indicated by direction arrows A and B, the mixing paddles 7, 8 of group 5 revolve in the opposite direction to the mixing paddles 9 of the outer group 6.

As can also be seen in FIG. 1, the mixing paddles 7 of the inner group 5 can have a larger radial spacing from the trough axis 4 than the mixing paddles 8 of the inner group. In addition, the two mixing paddles 7, 8 of group 5 can penetrate into the trough to a varying depth, as is also apparent from from FIG. 1.

Figure 2:
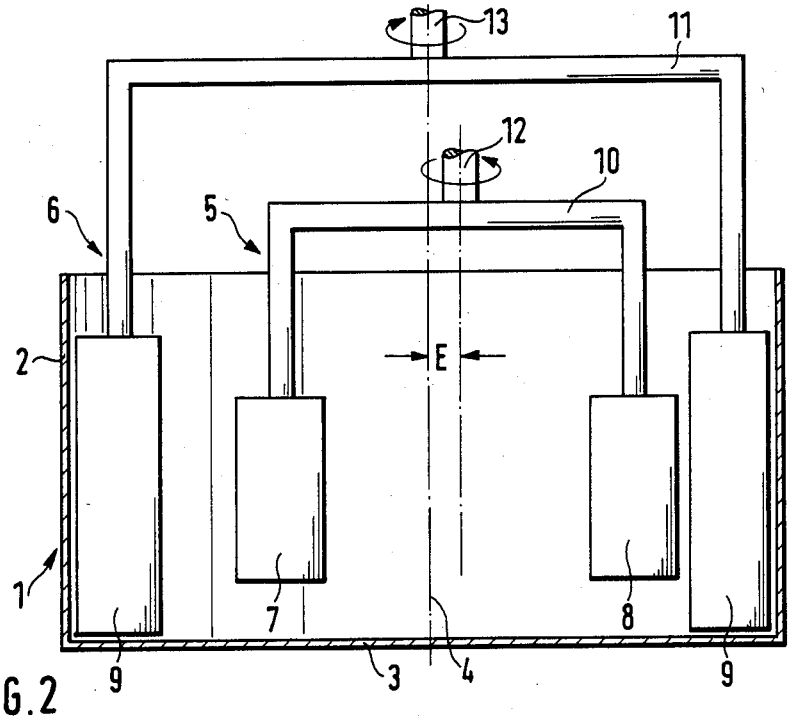
FIG. 2, a diagrammatic view of a further embodiment.

The embodiment of FIG. 2 differs from that of FIG. 1 essentially only in that the different radial spacing of mixing paddles 7, 8 of group 5 can also be achieved by an axial displacement of driving shaft 12 with respect to the trough axis 4 and this also leads to an eccentric circular path.

Figure 3:
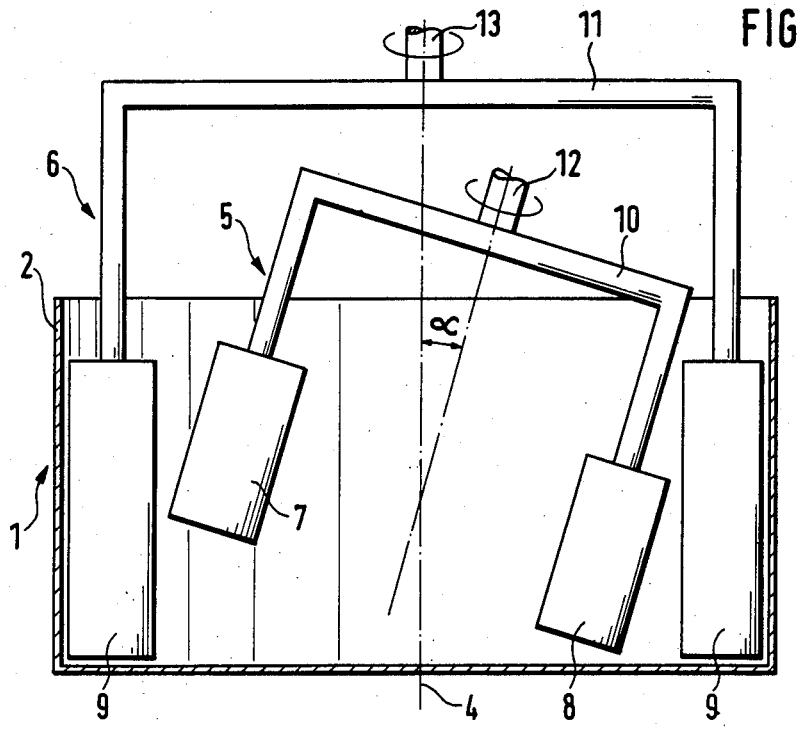
FIG. 3, a view of a third embodiment corresponding to FIGS. 1 and 2.

In the embodiment according to FIG. 3, the driving shaft 12 of the inner group 5 with mixing paddles 7, 8 is inclined by the angle $\alpha$ with respect to the trough axis 4 or the driving shaft 13 of the outer group 6, so that the mixing paddles 7, 8 are on the one hand arranged at different levels and on the other impart to the material being mixed both a horizontal and a vertical component of motion.

Apart from the above-described groups 5, 6 of mixing paddles 7, 8 or 9, the apparatus, as shown in FIGS. 4 to 9, also has at least one wall stripper 14 engaging with the outer trough wall 3, a horizontally positioned bottom stripper 16 and a wall stripper 17 associated with the inner trough wall 18. These strippers can comprise inclined strips.

Figure 8:
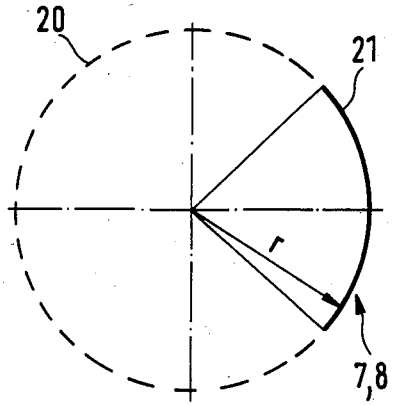
FIGS. 8 and 9, diagrammatic representations relating to the geometry of an embodiment of the mixing paddles.
Figure 9:
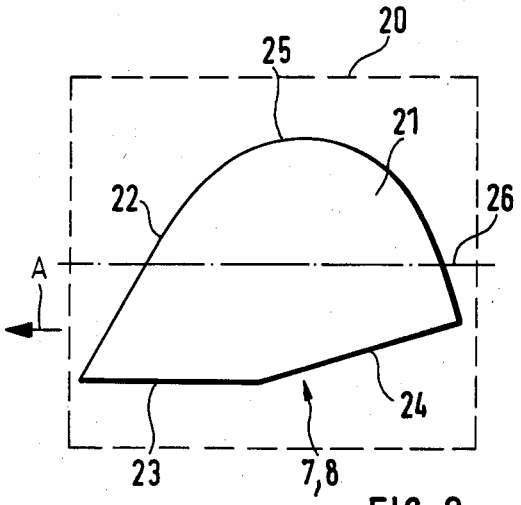

The mixing paddles 7, 8, 9 are curved in part cylindrical manner or are formed from cylinder cutouts. FIGS. 8 and 9 diagrammatically indicate the production of the paddles 7, 8 of the inner group 5, the broken lines indicating a cylinder 20, paddles 7, 8 being formed from a segment 21 of said cylinder, i.e. having a curvature of radius r (FIG. 8). The contour of segment 21 is apparent from the projection according to FIG. 9 , while the rotation direction A of paddles 7, 8 is indicated. Paddles 7, 8 have a leading cutting edge 22, which slopes up counter to rotation direction 14, as well as a further horizontal cutting edge 23.

In the represented embodiment, cutting edge 22 passes via an arcuate portion 25 into a rearwardly rising portion 24 of horizontal edge 23. The vertical line or the axis of curvature parallel thereto of paddles 7, 8 is indicated at 26 in FIG. 9.

Figure 4:
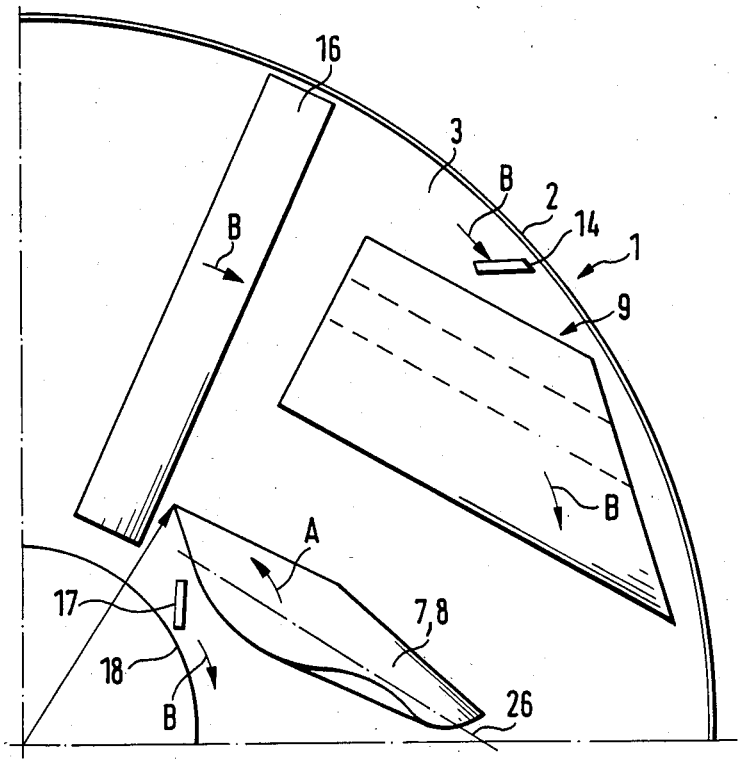
FIG. 4, a diagrammatic plan view of a sector of the trough of the apparatus.
Figure 5:
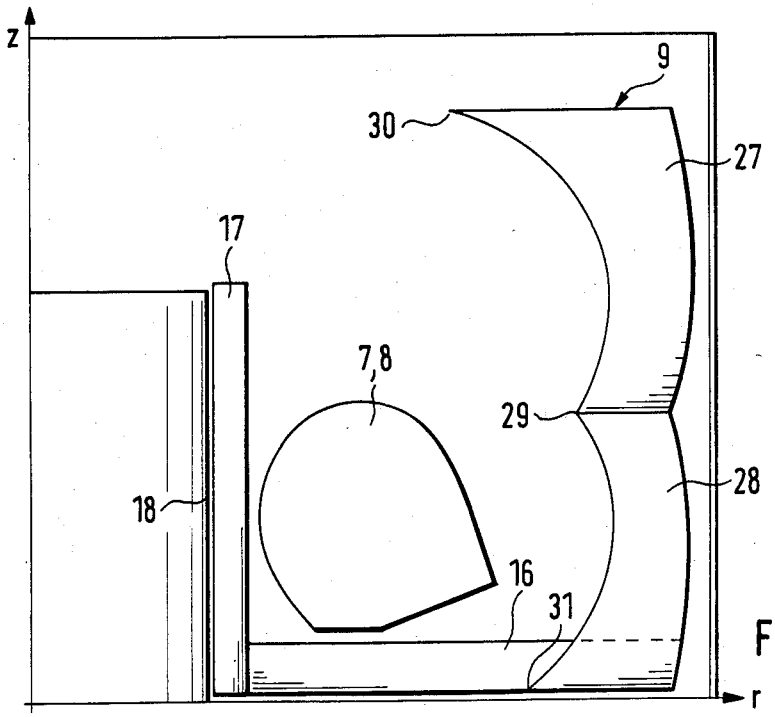
FIG. 5, a diagrammatic side view of the trough sector of FIG. 4.

As can be seen in FIG. 4, the vertical line or axis 26 of paddles 7, 8 is set at an angle to the tangent of the circular path, so that the material being mixed taken up by paddles 7, 8 is conveyed from the inside to the outside and is at the same time given a twisting movement. The mixing paddles 9 are formed from two superimposed pitch or part cylinders 27, 28, which are interconnected along a generatrix 29, once again located further outwards than the outer boundary edges 30, 31 of the two part cylinders 27, 28. In the embodiment according to FIGS. 4 and 5, the axis 26 of mixing paddles 7, 8 of the inner group 5 and the axes of the part cylinders 27, 28 of mixing paddles 9 of the outer group are positioned horizontally.

Figure 6:
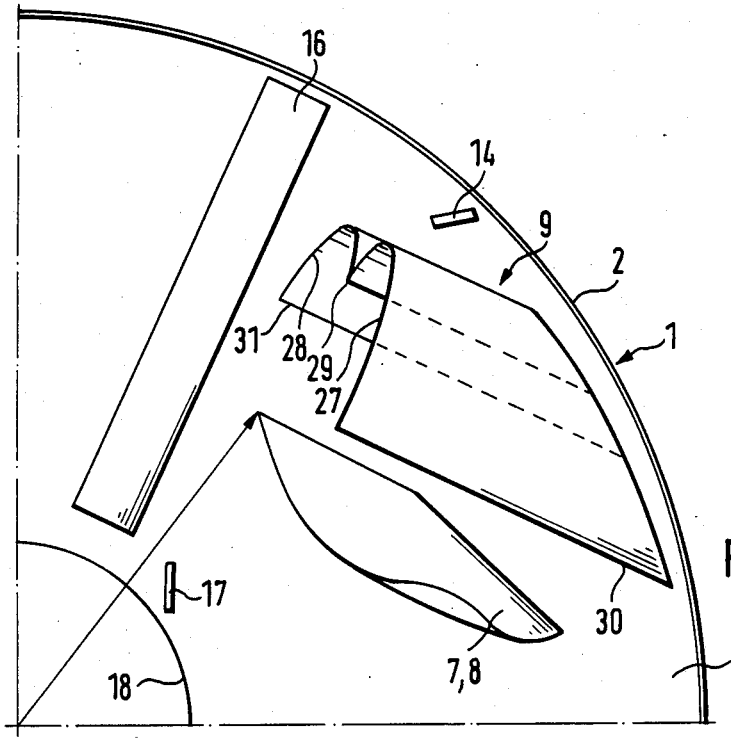
FIG. 6, a view corresponding to FIG. 4 of a trough sector in the case of a different construction and arrangement of the mixing paddles.
Figure 7:
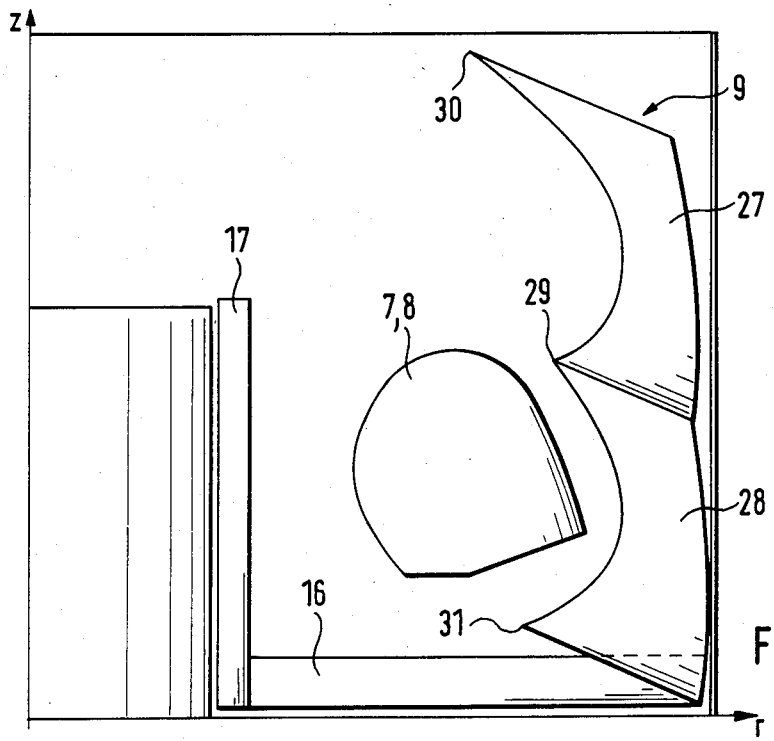
FIG. 7, a diagrammatic side view relative to FIG. 6.

Unlike in this embodiment, in the embodiment according to FIGS. 6 and 7, the axis of part cylinders 27, 28 rises counter to rotation direction 15. In addition, mixing paddles 7, 8 are positioned further radially outwards and engage less deeply in the trough.

Figure 10:
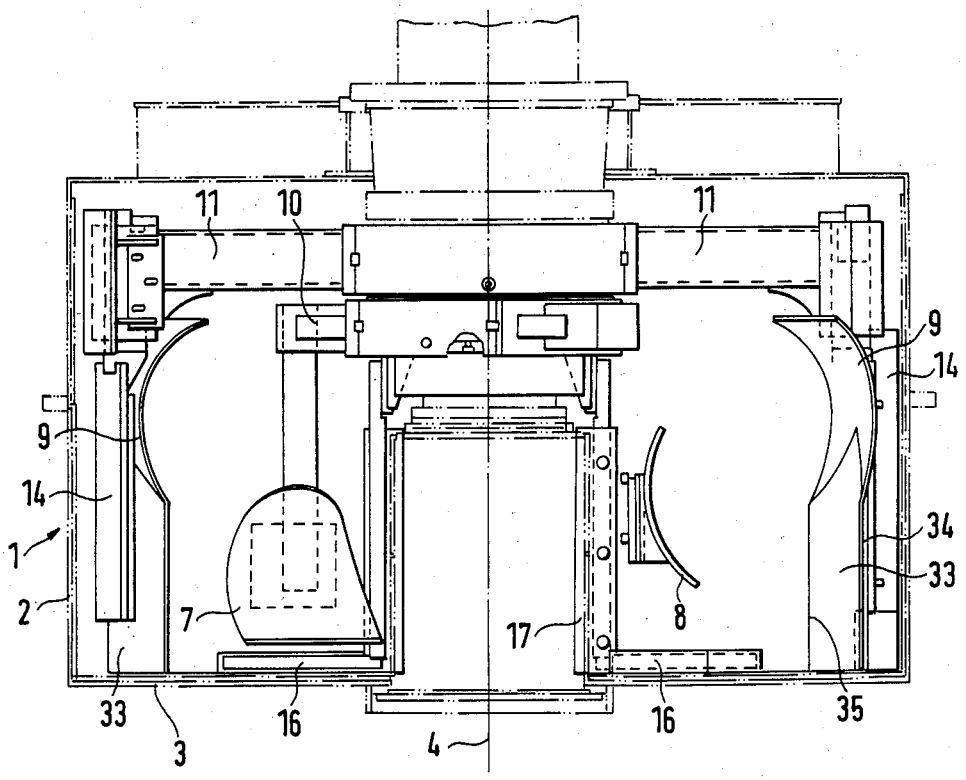
FIG. 10, an axial section through a mixer.
Figure 11:
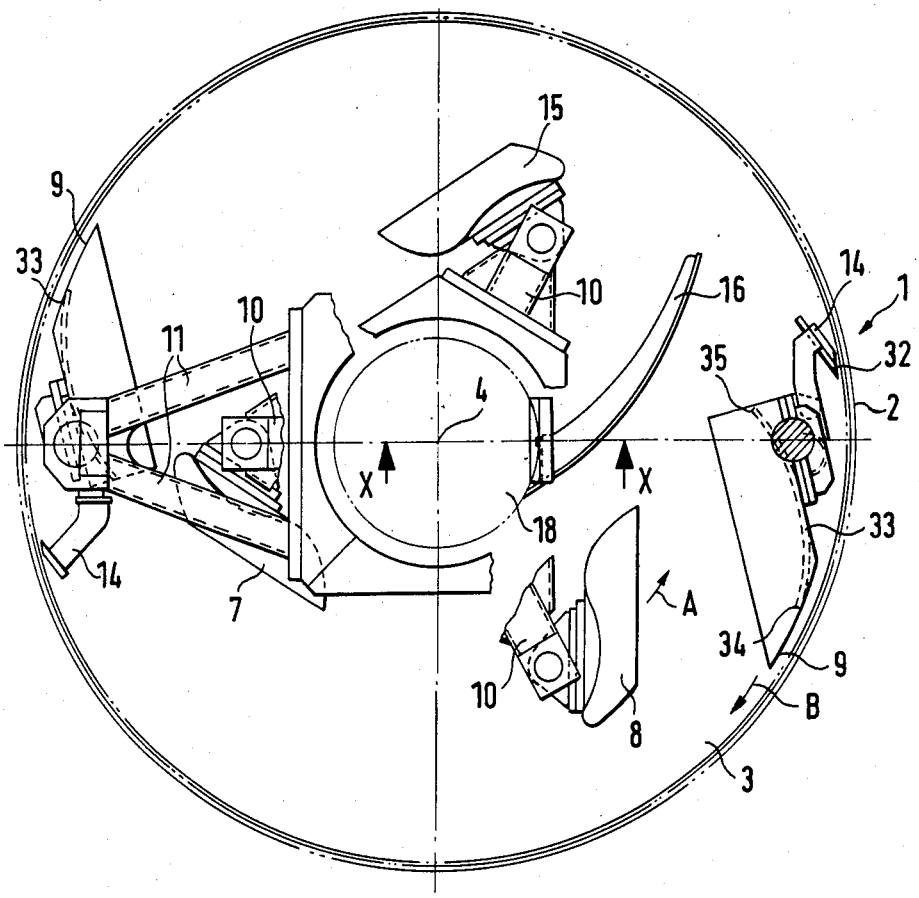
FIG. 11, a plan view of the mixer according to FIG. 10.

FIGS. 10 and 11 show a mixer construction, where parts are given the same reference numerals, so that only the differing features are described again. FIG. 11 clearly shows that, apart from mixing paddles 7, 8, the inner group also has a third mixing paddle 15 with the same contour. These three mixing paddles are arranged with different radial spacings from trough axis 4 (FIG. 11) and at different heights (FIG. 10) above the trough bottom 3. They all revolve in direction A. In addition, the outer group 6 has two diametrically positioned mixing paddles 9 with a horizontal axis of curvature, fitted to an in each case one supporting arm 11, together with in each case one wall stripper 14 for the outer trough wall 2. As shown in FIG. 11, wall stripper 14 runs behind the particular mixing paddle 9 in direction B and conveys the material into the free space formed by the paddles. Wall strippers 14, like those for the inner wall and trough bottom, have adjustable and interchangeable anti-wear strips 32.

With the mixing paddles 9 which, as shown in FIG. 10, are positioned at the top and extend to or above the mixer filling level, are associated further mixing paddles 33, which are formed from part cylinders with a vertical axis of curvature and which extend to the bottom 3 of trough 1. The horizontally and vertically arranged mixing paddles 9 and 33 are interconnected and fixed to supporting arms 11. The leading edge 34 of vertical mixing paddle 33 has a larger spacing from trough axis 4 than the trailing edge 35.

What is claimed is:

1. An apparatus for mixing solids with one another and with liquids, particularly for producing foundry moulding sand mixtures, the apparatus comprising:

a circular, fixed trough with a vertical axis and a bottom;

at least an inner group and an outer group of mixing tools fixed to arms, wherein the inner and outer groups of mixing tools revolve with a relative speed and in opposite directions with a different spacing from the trough vertical axis and from the trough bottom, and are inclined with respect to a tangent of their circular path or orbit under opposite angles, such that the outer group of mixing tools feed the material being mixed inwards and the inner group of mixing tools feed the material being mixed outwards, wherein the mixing tools are constructed in a paddle-like manner as circumferential segments of a circular cylinder having an approximately horizontally arranged axis to have a concave and a convex side; and the outer group of mixing tools have their concave side facing inwards toward the trough vertical axis, while the inner group of mixing tools have their concave side facing outwards from the trough vertical axis; and a twisting movement is imparted to the material being mixed, revolving wall strippers being associated with the insides of outer and inner trough walls.

2. An apparatus according to claim 1, wherein the mixing paddles have a cutting edge inclined counter to the revolving direction and a roughly horizontal, lower cutting edge.

3. An apparatus according to claim 2, wherein the inclined cutting edge passes into the lower cutting edge via an arcuately curved edge.

4. An apparatus according to claim 2, wherein the lower cutting edge of the mixing paddles comprises a horizontal portion and a portion which slopes upwards counter to the rotation direction.

5. An apparatus according to claim 1, wherein the mixing paddles with their axis of curvature slope upwards counter to the rotation direction thereof with respect to a horizontal plane.

6. An apparatus according to claim 1 , wherein the outer group of mixing paddles comprise two or more superimposed parallel circumferential segments of a circular cylinder connected along a generatrix.

7. An apparatus according to claim 6, wherein the generatrix of the two circumferential segments has a larger radial spacing from the trough vertical axis than outer edges bounding the circumferential segments.

8. An apparatus according to claim 1, wherein the inner group of mixing paddles have different spacings from the trough vertical axis.

9. An apparatus according to claim 1, wherein the inner group of mixing paddles have different spacings from the trough bottom.

10. An apparatus according to claim 1, wherein the inner group of mixing paddles are driven about an axis inclined to the trough vertical axis.

11. An apparatus according to claim 1, wherein the inner group of mixing paddles are driven about an axis arranged eccentrically to the trough vertical axis.

12. An apparatus according to claim 1, wherein associated with the outer group of mixing paddles are further partly cylindrical mixing paddles with a vertical axis of curvature, whose leading edge has a larger radial spacing from the trough vertical axis than the trailing edge.

13. An apparatus according to claim 12, wherein at least one partly cylindrical mixing paddle with a vertical axis of curvature is connected to each mixing paddle with a horizontal axis, the mixing paddle with a horizontal axis being located above the mixing paddle with a vertical axis, the mixing paddle with a vertical axis extending roughly to the trough bottom .

14. An apparatus according to claim 1, wherein the outer group of mixing paddles with a horizontal axis of curvature project over the surface of the material being mixed.

15. An apparatus according to claim 1, wherein the wall strippers for the inner trough wall revolve synchronously with the inner group of mixing paddles and the wall strippers for the outer trough wall revolve synchronously with the outer group of mixing paddles .

16. An apparatus according to claim 1, wherein at least one wall stripper for the outer trough wall is positioned in the revolving direction behind each mixing paddle of the outer group of mixing paddles.

17. An apparatus according to claim 1, wherein the wall strippers have at least one of interchangeable and adjustable anti-wear strips.

* * * * *